US005906349A

United States Patent [19]

Roy

[11] Patent Number: 5,906,349

[45] **Date of Patent: *May 25, 1999**

[54] PICTURE HANGER WITH SPACER ELEMENTS FOR ALIGNMENT DURING STACKING

[75] Inventor: Armand E. Roy, Atleboro, Mass.

[73] Assignee: Craft, Inc., South Attleboro, Mass.

[ * ] Notice: This patent is subject to a terminal disclaimer.

[21] Appl. No.: 08/910,621

[22] Filed: Aug. 13, 1997

[51] Int. Cl.[6] ..... A47G 1/16

[52] U.S. Cl. ..... 248/489; 248/497; 248/496; 248/903; 248/909; 40/757

[58] Field of Search ..... 248/489, 496, 248/477, 546, 497, 498, 684, 690, 691, 217.3, 300, 291.1, 294.1, 903, 909; 40/757, 759, 617

[56] References Cited

U.S. PATENT DOCUMENTS

| | | | |
|---|---|---|---|
| D. 397,927 | 9/1998 | Roy | D8/373 |
| 769,794 | 9/1904 | Fowler | 248/489 |
| 1,676,485 | 7/1928 | Finucane | 248/300 |
| 2,082,577 | 6/1937 | Herschmann | 248/489 X |
| 2,448,137 | 8/1948 | Cody | 248/497 |
| 2,483,114 | 9/1949 | Van Schoor et al. | 248/498 X |
| 3,536,287 | 10/1970 | Kramer | 248/909 X |
| 3,982,719 | 9/1976 | Kilborne | 248/489 |
| 5,048,788 | 9/1991 | Lorincz | 248/497 X |
| 5,328,139 | 7/1994 | Barnes | 248/217.3 X |

*Primary Examiner*—Derek J. Berger
*Assistant Examiner*—Stephen S. Wentsler
*Attorney, Agent, or Firm*—Barlow, Josephs & Holmes

[57] ABSTRACT

An elongated strip of connected picture hangers adapted to be coiled around a feeding reel and fed into an assembly machine for further processing and for automatic attachment of the picture hangers to the backing of picture frames, each hanger comprising substantially planar metallic body portion having a living hinge extending thereacross for allowing the hanger to be accepted by the assembly machine. A portion of the body of the hanger is cut out for receiving support means from the desired hanging location. A reinforcement rib extends along the top edge of the hanger for strengthening the picture hanger for larger and heavier type picture frames. A pair of dimpled protrusions automatically bias the picture hanger away from the picture frame backing for easier attachment of the picture hanger to the display support means. The arrangement of the above features provides for spacing means which allows for proper stacking of the picture hangers around the feeding reel.

3 Claims, 6 Drawing Sheets

PICTURE HANGER WITH SPACER ELEMENTS FOR ALIGNMENT DURING STACKING

BACKGROUND AND SUMMARY OF THE INVENTION

This invention relates generally to picture frames and more particularly to a picture frame hanger of the type used to attach a picture frame to a wall or other visibly aesthetic location.

Various methods of displaying picture frames have heretofore been available in the art. One such method available is to have an integrally formed support leg hingedly attached to the back of the picture frame movable between an open position where the leg extends outwardly from the back of the frame and a closed position where the leg remains flush with the back of the picture frame. Such display means are preferably used for smaller type picture frames wherein the support leg is moved to the outer position for supporting the picture frame in an upright position in the desired display location. Another such method available, utilized for larger type picture frames, is to have a picture hanger attached to the back of the picture frame for supporting a picture frame on a wall or any other desirable location lacking horizontal support.

The instant invention is directed to a picture hanger that is manufactured in strip form and then is coiled around a feeding reel and subsequently fed into an assembly machine for automatic processing and attachment of the picture hanger to the back side of a picture frame. The combination of the picture hanger adapted to be coiled on a feeding reel and fed into an assembly machine provides for the efficient and expeditious assembly of the hangers to the back side of picture frames in a continuing operation.

The picture hanger of the instant invention comprises a substantially planar metallic body portion having opposing top, bottom and side edges. A living hinge extends generally across the middle portion of the body of the hanger from one side to the other for allowing the hanger to be compatible with the assembly machine during processing and attachment of the hanger to the back side of a picture frame. A portion of the body of the hanger adjacent the living hinge is cut out and the top edge of the cut-out area has teeth-like formations formed therein for receiving support means, such as a nail, from the desired location where the picture is to be displayed. An elongated rib, integrally formed, extends along the top edge of the body of the hanger to provide extra strength to the picture hanger when displaying larger and heavier type picture frames. The reinforcement rib also acts as a spacing element enabling the strip of hangers to be neatly stacked on the feeding reel. Lastly, a first and second pair of opposing dimple-like protrusions extend in opposite directions from the body of the hanger whereby the first pair also acts as a spacer enabling the strip of hangers to be neatly stacked on the feeding reel, and the second pair biases the hanger away from the picture backing, after attachment, for easier insertion of the hanging support member into the aforesaid teeth-like formations of the picture hanger.

Accordingly, among the several objects of the instant invention are: the provision of picture hangers made by a progressive tool in strip form and adapted to be coiled around a feeding reel and fed into an assembly machine for more efficient attachment of a large number of the picture hangers to the back side of picture frames in an automatic and continuous operation; the provision of a picture hanger having multiple spacing elements for proper alignment when stacking the hangers on the feeding reel; the provision of a picture hanger that is more efficiently attached to the back side of a picture frame in both a horizontal and vertical orientation; and the provision of a picture hanger that is automatically biased away from the picture backing for easier attachment of the picture hanger to a display support.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

Corresponding reference numbers designate corresponding parts throughout the drawings.

DESCRIPTION OF THE PREFERRED EMBODIMENT

Figure 1:
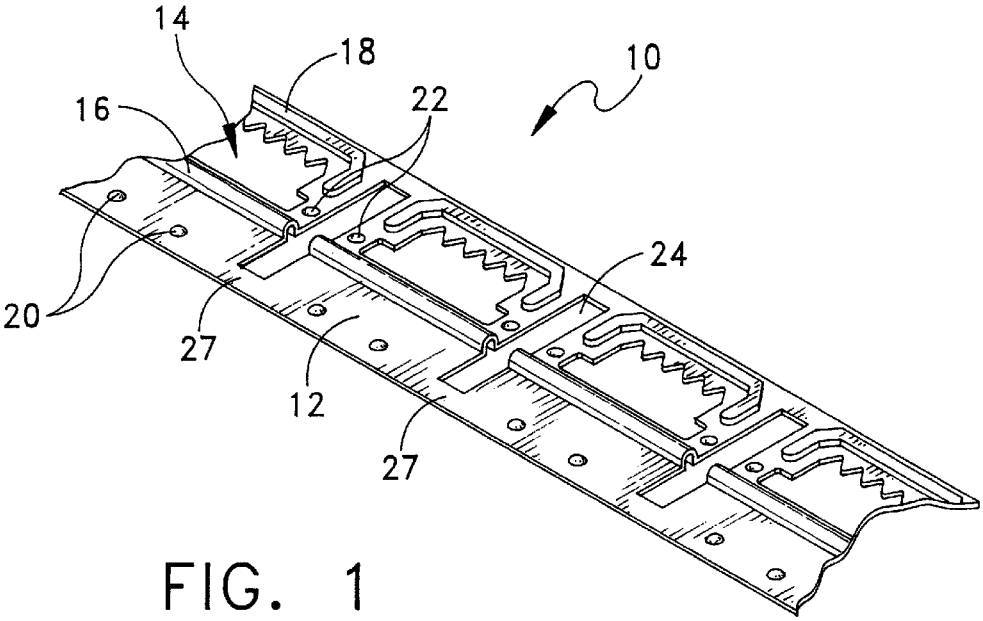
FIG. 1 is a fragmentary perspective view illustrating a continuous strip of the picture hangers after the initial tooling operations.
Figure 3:
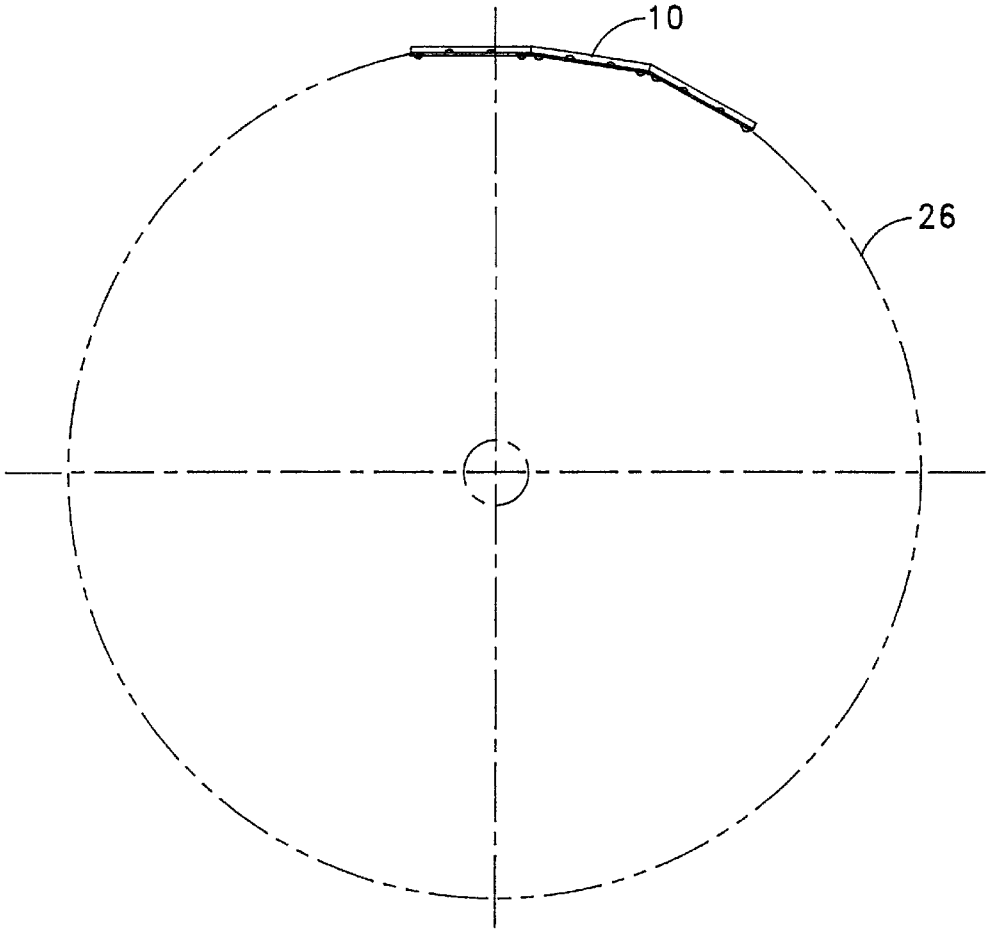
FIG. 3 is a side view illustrating the picture hangers coiled around a reel.

Referring now to the drawings, and more particularly to FIG. 1, a portion of a continuous strip of the picture hangers of the instant invention is shown and generally indicated at 10, it being understood that the strip 10 is preferably metallic and is made from a progressive tool. As will hereinafter be more fully described, the instant invention relates to a picture hanger that is in a continuous strip which is then coiled as illustrated in FIG. 3. The coil of hangers are adapted to be neatly stacked and twisted around a feeding reel that is connected to an assembly machine which then processes and automatically attaches the picture hangers to the back side of picture frames or any other desirable backings.

Figure 2:
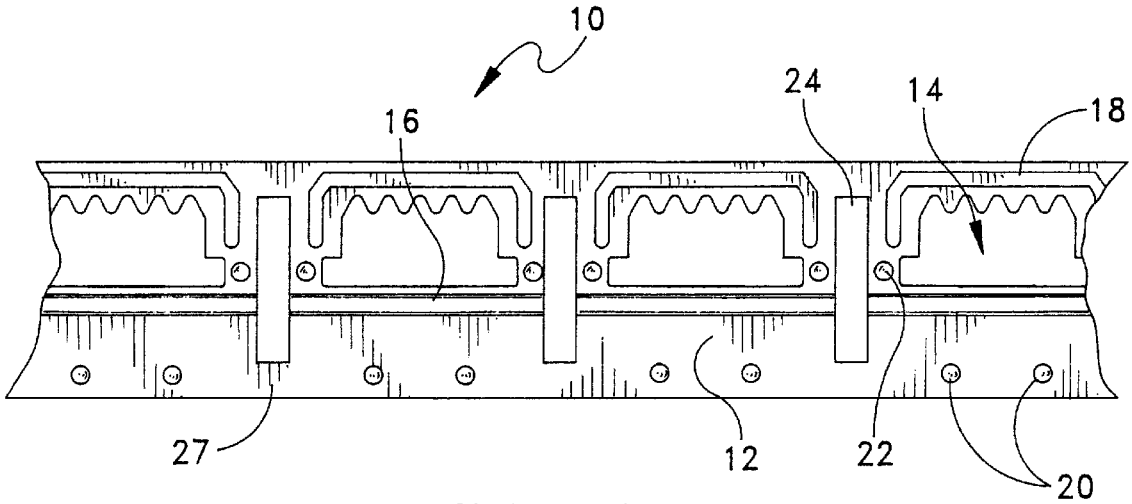
FIG. 2 is a top plan view illustrating the picture hangers shown in FIG. 1.

Referring first to FIGS. 1–2, the continuous strip of picture hangers 10 are shown wherein adjacent hangers are connected at respective side edges thereof defining the continuous strip of picture hangers. Generally, each hanger 10 includes a substantially planar body 12 wherein a portion of the body is cut out, generally indicated at 14, for receiving a display support at the desired display location. The hanger further includes a living hinge 16 which extends generally across the middle portion of the body 12 of the hanger 10, a reinforcing rib 18 extending across the top edge of the body 12 of the hanger 10, and two pairs of dimple-like protrusions 20 and 22, each pair protruding in an opposite direction from the body 12 of the hanger 10.

Basically, an assembly machine, not shown, severs each hanger 10 from the coiled strip (with a cutting mechanism) at rectangular cut-out areas 24 located in the strip between adjacent hangers. More specifically, the cutting mechanism cuts at approximately a forty-five degree angle 25 from each corner of rectangular cut-outs 24 defining a v-shape between separated hangers and eliminating the pointed corners of the separated hangers. Besides separating the hangers from the coiled strip, as described above, the assembly machine is also operable for punching a plurality of rosettes in each hanger and then automatically attaching each hanger to the back side of a picture frame.

Figure 4:
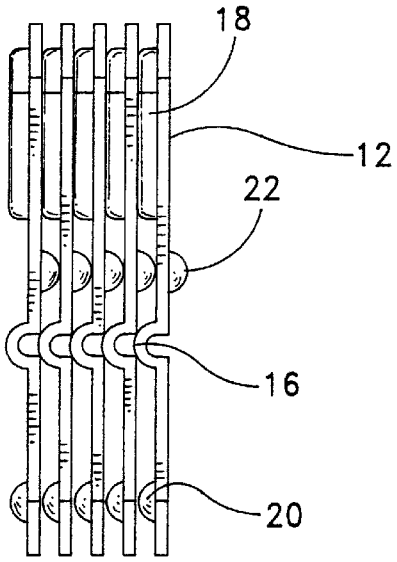
FIG. 4 is a side view illustrating the stacking relationship of the coiled picture hangers when twisted around a reel.
Figure 5:
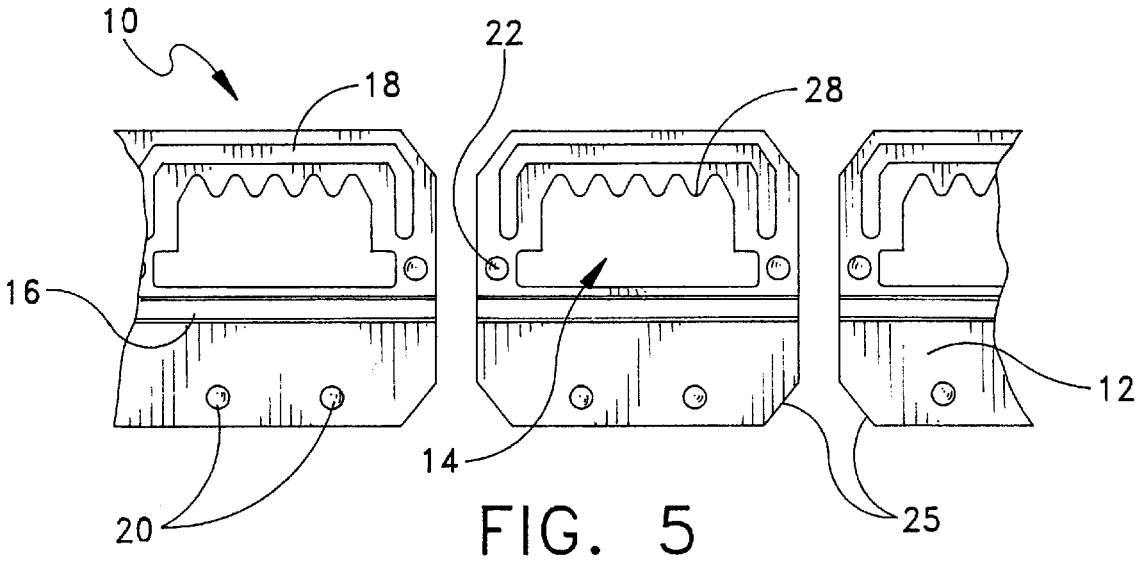
FIG. 5 is a top plan view showing the picture hangers after they have been severed from each other.

FIG. 3 illustrates a portion of the coiled strip of picture hangers 10 twisted around a feeding reel 26. The hangers are preferably fabricated from a rigid metallic material, however; when the coiled strip of picture hangers are wrapped around the feeding reel, the hangers are thin enough so that they may bend and conform to reel 26, the bending normally taking place at areas of weakness, such as at 27. FIG. 4 more clearly illustrates the stacking relation of the coiled strip of hangers 10 as it wraps around the feeding reel 26. The arrangement is such that the strip of hangers 10 are coiled around the shaft of the feeding reel 26 until the reel is fully loaded. This results in a spiraling coil of hangers stacked upon each other in the manner depicted in FIG. 4. As shown in the drawing, integrally formed reinforcing rib 18 and pairs of oppositely protruding dimples 20 and 22 are crucial spacing elements for neat stacking of the coiled strip around the shaft of the feeding reel. Specifically, each corresponding element is in a touching relation with the back side of the next above coiled picture hanger.

Figure 6:
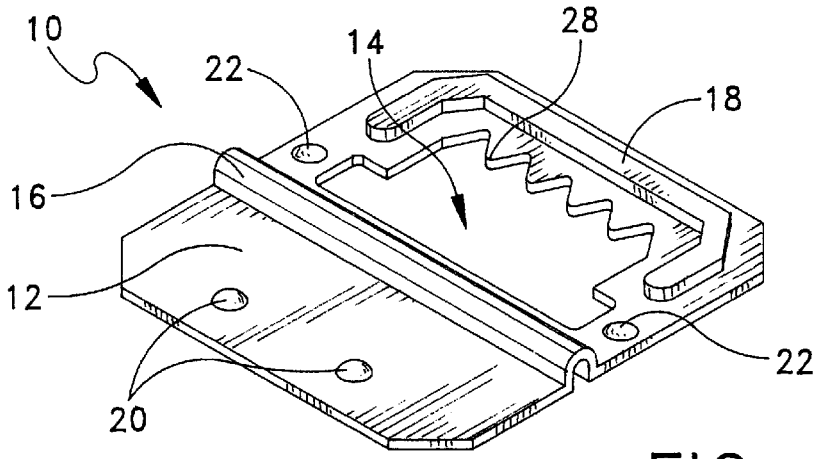
FIG. 6 is a perspective view of the picture hanger shown in FIG. 5.
Figure 7:
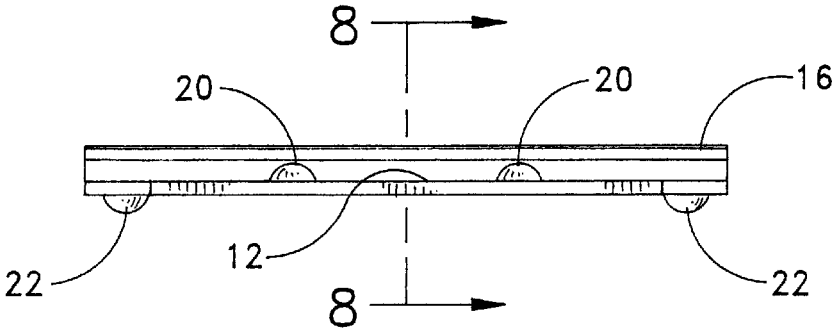
FIG. 7 is a front edge view of the picture hanger shown in FIG. 6.
Figure 8:
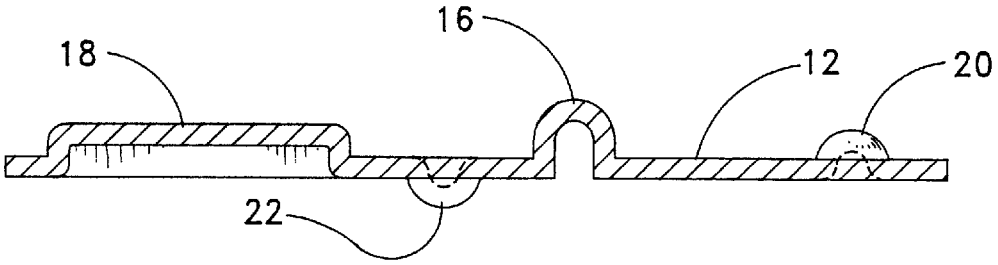
FIG. 8 is a cross-sectional view taken along line 8—8 of FIG. 7.
Figure 9:
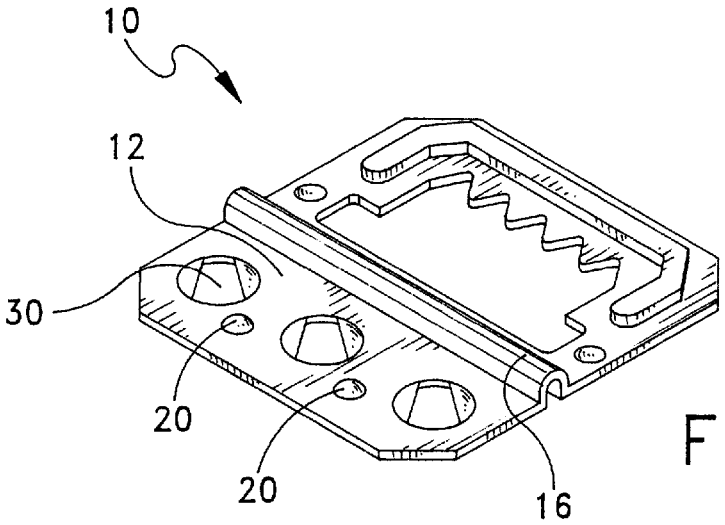
FIG. 9 is a perspective view of the picture hanger shown in FIG. 6 after having rosettes formed therein.
Figure 10:
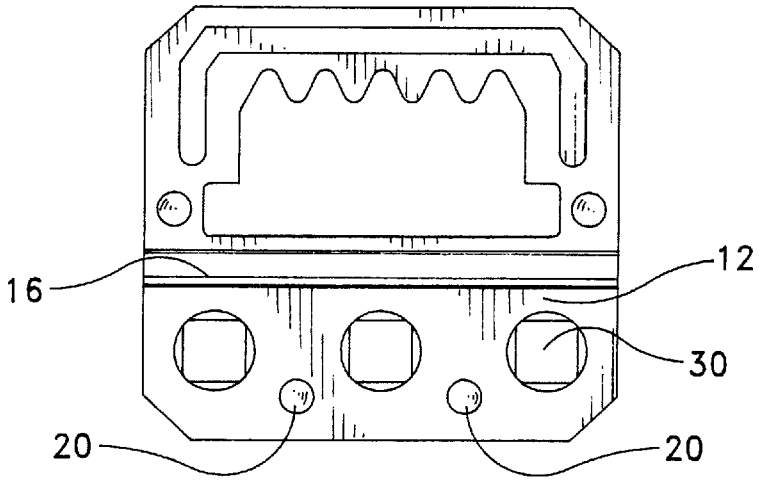
FIG. 10 is a top plan view of the picture hanger shown in FIG. 9.
Figure 11:
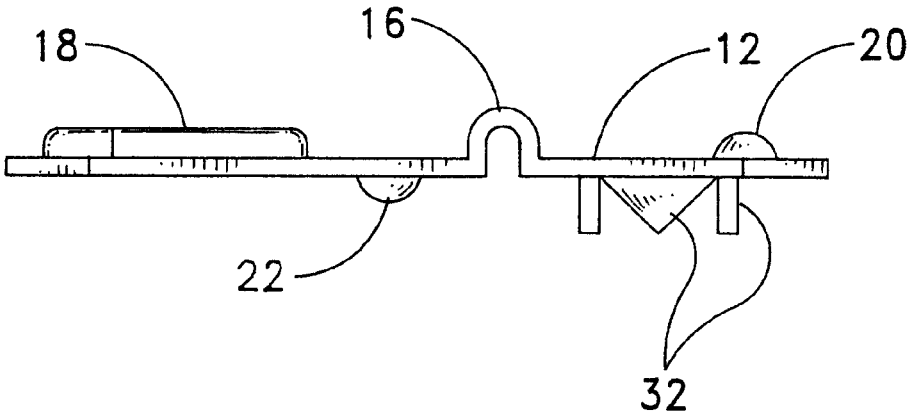
FIG. 11 is a side edge view of the picture hanger shown in FIG. 10.
Figure 12:
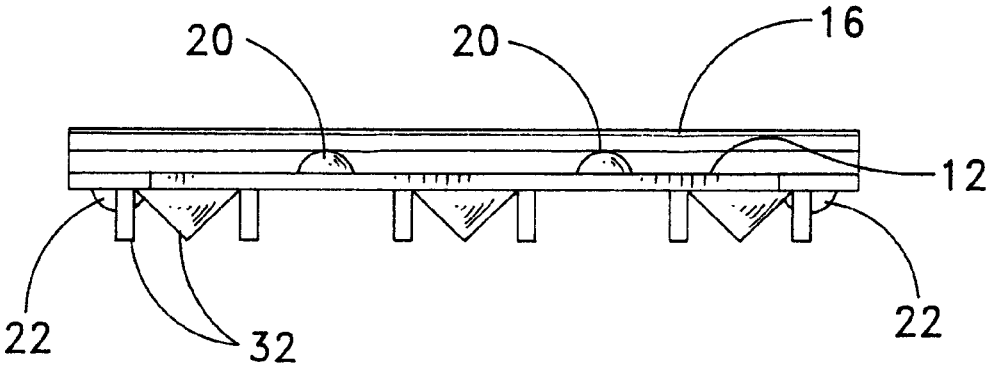
FIG. 12 is a front edge view of the picture hanger shown in FIG. 10.

Referring to FIGS. 5–8, the picture hanger 10 of the instant invention is shown severed from the continuous coiled strip. Specifically, corner edges of each hanger are cut at approximately a forty-five degree angle defining generally rounded-off corners for each hanger separated from the coiled strip. FIGS. 6–8 more clearly illustrate each element of the hanger. Specifically, the hanger comprises a body 12 having front and back sides and opposing top, bottom and side edges. A living hinge 16 extends generally across the middle portion of the front side of the body 12 of the hanger 10. The hinge 16 can be defined as an integral tubular barrel in the body 12 of the hanger 10 having an inverted u-shape in cross-section. The hinge 16 adds no functional utility to the value of the hanger 10, but is important to the final manufacturing process of the hanger. Specifically, the hinge 16 allows the picture hanger 10 of the instant invention to be compatible with existing assembly apparatus that may be modified and used for final processing and attachment of the instant hanger to the back of a picture frame. Adjacently located on opposing sides of the living hinge 16 are a front pair of dimple-like protrusions 20 protruding from the front side of the body 12 of the hanger 10 and a back pair of dimple-like protrusions 22 protruding from the back side of the body 12 of the hanger 10. The front pair of dimpled protrusions 20 add no functional utility to the hanger 10, but are critical spacing elements for the coiled strip of hangers to be properly stacked on the feeding reel 26. The back pair of dimpled protrusions 22 biases the picture hanger 10 away from the back side of the picture frame for an easier attachment of the picture frame to a display support at the desired display location. The back pair of dimpled protrusions 22 are also critical spacing elements for appropriate stacking of the coiled strip around the shaft of the feeding reel 26. The hanger further includes a raised reinforcing rib 18 which extends along the top edge of the front side of the body 12 of the hanger 10 and continues down a small portion of the body 12 side edges. The reinforcing rib 18 adds strength to the top edge of the body 12 of the hanger 10 for larger or heavier type picture frames. The reinforcing rib 18 is also a critical spacing element for proper alignment of the coiled hangers stacked around the feeding reel 26, all as most clearly shown in FIG. 4. Lastly, a portion of the body 12 of the hanger 10 between the living hinge 16 and reinforcing rib 18 has a cut-out 14 having teeth-like formations 28 formed around the top edge of the cut-area 14 for receiving a display support such as a nail or the like, at the desired display location.

FIGS. 9–12 illustrate the finished picture hanger 10 of the instant invention separated from the coiled strip and having a plurality of rosettes formed therein indicated at 30. Specifically, three rosettes each indicated at 30 are formed along the bottom portion of the body 12 substantially between the living hinge 16 and the front pair of dimpled protrusions 20. Each rosette 30 has two pairs of oppositely positioned legs 32 (FIG. 13) which extend downwardly from the back side of the body 12 of the hanger 10. Each pair of legs 32, totaling four, has a sharp penetrating triangular shape for penetration into the backing 34 of a picture frame. The rosettes 30 provide fastening means between the bottom portion of the picture hanger 10 and the backing of a picture frame.

Figure 13:
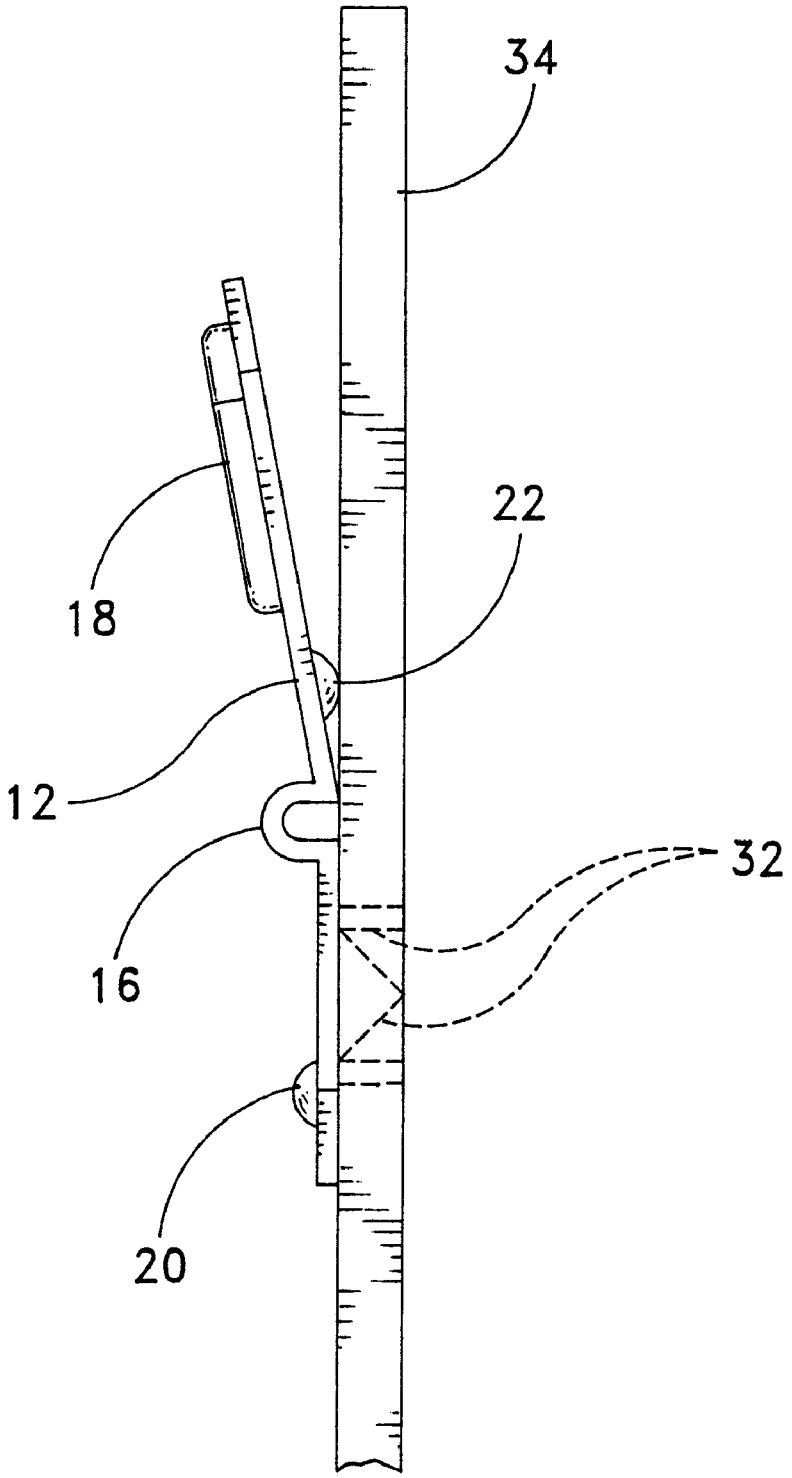
FIG. 13 is a side view illustrating the picture hanger attached to a picture frame backing.

In use, the picture hanger 10 is attached to a picture frame backing 34 as illustrated in FIG. 13. As depicted in the drawing, the triangularly shaped legs 32 of each rosette 30 penetrates the picture backing 34 so as to be embedded within the body of the backing 34. The rosettes 30 attach the hanger 10 to the back of the picture frame 34 in such a manner that the legs 32 do not penetrate completely through the backing 34 but remain embedded within the body of the picture backing. The rosettes 30 securely fasten the hanger 10 to the backing 34 without any sharp dangerous edges protruding through the back of the frame 34. The back pair of dimpled protrusions 22 are shown in FIG. 13 biasing the top detached portion of the hanger 10 away from the picture backing 34 enabling easier mounting of the hanger 10 on a display support, such as a nail or the like.

It can therefore be seen that the instant invention provides for an effective arrangement of picture hangers that may be coiled around a feeding reel and fed into an assembly machine for efficient processing and automatic attachment of the hangers to the back of picture frames. Further, the instant picture hanger has means for automatically biasing the detached top portion of the hanger away from the picture backing for easier mounting on the display support. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A picture hanger produced from elongated strips of connected picture hangers adapted to be coiled around a feeding reel associated with an assembly machine which receives said strip for further processing and for automatic attachment of the picture hangers to a picture frame assembly, said picture hanger comprising:

a substantially planar body portion having a top edge, a bottom edge, a left edge and a right edge;

a cut-out adjacent to but spaced from said top edge for receiving therethrough a hanging support member to suspend said hanger and any frame assembly to which the hanger is attached;

an integrally formed reinforcing rib extending generally between said left edge and said right edge and extending in a first direction from the plane of said body portion, said rib being located between said cut-out and said top edge;

a first pair of protuberances extending from the plane of said body portion in said first direction; and a second pair of protuberances extending from the plane of said body portion in a direction opposite to said first direction;

an integral barrel-like living hinge extending between said left edge and said right edge, said hinge extending from the plane of said body portion in said first direction, said hinge enabling said hanger to be compatible with the assembly machine;

said reinforcing rib, said first pair of protuberances, said second pair of protuberances, and said hinge functioning as spacing means to permit proper stacking of the hangers as the strip is coiled around the feeding reel.

2. A picture hanger comprising:

a substantially planar body portion having a top edge, a bottom edge, a left edge and a right edge;

a cut-out defined by said substantially planar body portion; said cut-out being bounded about its periphery by said substantially planar body portion; said cut-out being bounded at its upper region by an upper support member of said substantially planar body portion; said cut-out being adjacent to but spaced from said top edge for receiving therethrough a hanging support member in communication with said upper support member of said substantially planar body portion to suspend said hanger and any frame assembly to which the hanger is attached;

an integrally formed reinforcing rib extending generally between said left edge and said right edge and extending in a first direction from the plane of said body portion; said rib being located between said cut-out and said top edge;

an integral barrel-like living hinge extending from said left edge to said right edge, said hinge extending from the plane of said body portion in said first direction;

a first pair of protuberances extending from the plane of said body portion in said first direction; and a second pair of protuberances extending from the plane of said body portion in a direction opposite to said first direction.

3. The picture hanger of claim 2 wherein said body portions is metallic.

* * * * *